US007673423B2

(12) United States Patent
Podirsky

(10) Patent No.: US 7,673,423 B2
(45) Date of Patent: Mar. 9, 2010

(54) CLADDING APPARATUS, METHOD AND SYSTEM

(75) Inventor: Bernhard Podirsky, Queensland (AU)

(73) Assignee: B-Pods Holdings Pty. Ltd., Queensland (AU)

( * ) Notice: Subject to any disclaimer, the term of this patent is extended or adjusted under 35 U.S.C. 154(b) by 1371 days.

(21) Appl. No.: 10/517,273

(22) PCT Filed: Jun. 13, 2003

(86) PCT No.: PCT/AU03/00743

§ 371 (c)(1),
(2), (4) Date: Dec. 9, 2004

(87) PCT Pub. No.: WO03/106781

PCT Pub. Date: Dec. 24, 2003

(65) Prior Publication Data

US 2006/0070323 A1 Apr. 6, 2006

(30) Foreign Application Priority Data

Jun. 14, 2002 (AU) ..... PS 2970

(51) Int. Cl.
*E04D 13/00* (2006.01)
*E04D 3/40* (2006.01)
*E04B 7/00* (2006.01)

(52) U.S. Cl. ..... 52/96; 52/539; 52/541; 52/549

(58) Field of Classification Search ..... 52/533, 52/536, 539, 541, 546, 538, 542, 547, 549, 52/550, 552, 95, 96, 97
See application file for complete search history.

(56) References Cited

U.S. PATENT DOCUMENTS

| | | | | |
|---|---|---|---|---|
| 4,040,211 | A * | 8/1977 | Wotherspoon | 52/100 |
| 4,914,885 | A * | 4/1990 | Baker et al. | 52/520 |
| 5,048,255 | A * | 9/1991 | Gonzales | 52/533 |
| 5,074,093 | A * | 12/1991 | Meadows | 52/537 |
| 5,305,570 | A * | 4/1994 | Rodriguez et al. | 52/520 |
| 5,555,680 | A | 9/1996 | Sweers | |
| 5,636,481 | A * | 6/1997 | De Zen | 52/95 |
| 6,269,604 | B1 * | 8/2001 | Pedersen | 52/537 |
| 7,003,922 | B2 * | 2/2006 | Fifield | 52/302.1 |
| 2003/0089064 | A1 * | 5/2003 | Faulkner et al. | 52/408 |

FOREIGN PATENT DOCUMENTS

| | | |
|---|---|---|
| AU | 45519/72 | 2/1974 |

(Continued)

*Primary Examiner*—Richard E Chilcot, Jr.
*Assistant Examiner*—Chi Q Nguyen
(74) *Attorney, Agent, or Firm*—Saliwanchik, Lloyd & Saliwanchik

(57) ABSTRACT

There is provided cladding apparatus comprising a body portion (108) having an inner surface (110) and an outer surface (112) extending longitudinally between a leading edge (114) and a trailing edge (116) and transversely between opposed side edges (118). The leading edge (114) is provided with a formation (124) which inter-engages with complementary formation (126) provided on an adjacent body portion thereby permitting the body portions to inter-engage when laid in a longitudinal sequence. The body portion (108) is provided with a pair of longitudinally extending elongate mounting portions (128) on the inner surface (110) thereof. A longitudinal mounting batten (144) is attached to the fascia panel (106) adjacent to the exposed edge of the tiles (104), and into which the elongate mounting portions (128) may slide. A roof batten (132) is laid on the tiles and has on its lower face a plurality of steps which compensate for the overlapping nature of the tiles to provide a level upper face (140) when laid on the tiles (104), the upper face (140) forming a labyrinth with the inner surface (110) to assist in excluding weather in use.

12 Claims, 7 Drawing Sheets

FOREIGN PATENT DOCUMENTS

| | | | |
|---|---|---|---|
| CA | 1300338 | A | 12/1992 |
| DE | 29 10 340 | A1 | 9/1980 |
| DE | 33 32 841 | A1 | 5/1984 |
| DE | 87 05 794 | | 6/1987 |
| DE | 40 11 524 | A1 | 11/1990 |
| DE | 94 17 903 | U1 | 12/1994 |
| EP | 394150 | A | 10/1990 |
| EP | 519856 | B1 | 4/1996 |
| EP | 0 965 704 | A | 12/1999 |
| FR | 2 562 591 | | 10/1985 |
| GB | 2 094 365 | | 9/1982 |
| GB | 2294275 | A | 4/1996 |
| GB | 2 299 595 | A | 10/1996 |
| WO | WO 98/24992 | | 6/1998 |

* cited by examiner

CLADDING APPARATUS, METHOD AND SYSTEM

This application is a National Stage Application of International Application Number PCT/AU03/00743, filed Jun. 13, 2003; which claims priority to Australian application PS 2970, filed Jun. 14, 2002.

BACKGROUND OF THE INVENTION

This invention relates to cladding apparatus and methods and systems. More particularly, this invention has application in roofing and thus roofing apparatus, its method of implementation and to a roofing structure formed thereby are, for illustrative purposes described hereinafter with reference to this application. However, the apparatus, methods and structures formed by embodiments of the present invention may readily find application in wall cladding, lining and other structural applications.

BRIEF SUMMARY OF THE INVENTION

In one aspect the present invention resides broadly in cladding apparatus for covering the junction between adjacent cladding portions of a building including:

- an elongate body member having an inner surface and an outer surface, each surface extending between opposed ends and opposed elongate side edges of the body member;
- mounting means associated with at least one of said adjacent cladding portions and adapted to engage at least one complementary mounting portion provided on said inner surface;
- complementary inter-engaging means provided on respective said opposed ends and permitting substantially weatherproof engagement between adjacent body members when laid in longitudinal sequence.

The adjacent cladding portions may be a roof and a wall, and the invention is described hereinafter with reference to this construct. However, the adjacent cladding portions may well be the meeting of two roof portions or two wall portions.

Where the junction is between a roof and a wall, the body member portion overlying the roof is may be adapted to impede the ingress of weather under the body member in use. For example the elongate edge may be provided with a weather strip or the like. In preferred embodiments of the present invention, the means for preventing ingress of weather may be provided by a flange dependent toward the roof from, and extending along, the elongate edge. The roof may be provided with an elongate roof batten sealingly supported on the roof within the flange and may include an upper surface against which the inner surface of said body member bears in use. One or both of the inner surface and upper surface may be provided with one or more elongate grooves forming in use a moisture excluding labyrinth between the inner surface and said upper surface. The flange in use may have its lower edge clear of said roof, so as not to interfere with intimate contact of the upper and inner surfaces. Where the roof comprises a shingle laid roof, the roof batten may have a profile selected to conform to a shingle laid roof.

The mounting means may comprise a mounting batten secured to one or both of said adjacent cladding portions. The mounting portion and mounting means may be provided with complementary profiles permitting snap-in connection therebetween. Alternatively, the mounting portion and mounting means may be provided with complementary profiles permitting connection therebetween by longitudinally sliding the mounting portion on the mounting means.

Where there is a sliding connection, the mounting portion and mounting means may be substantially continuous along their respective lengths, whereby the body members may be sequentially installed by sliding from one end of the mounting batten. Alternatively, mounting portion and mounting means may be complementarily interrupted whereby the body members may be sequentially installed by offering up the body members to the batten intermediate its ends and sliding the body members into engagement with the batten.

The complementary profiles for sliding engagement may comprise a longitudinal bolt and track pair. By "bolt and track pair" it is meant configuration in the manner of a bolt rope and track arrangement, whereby an elongate lug or bolt having substantially the section of a solid of rotation is supported on a web, the complementary track having a cavity of substantially the same solid-of-rotation section accessed by a slot, the lug or bolt entering the cavity at its end and the web passing through the slot.

The mounting means may be substantially concealed from view in use by providing the elongate edge adjacent the mounting portion with a flange dependent toward said cladding from, and extending along, the elongate edge.

The complementary inter-engaging means provided on the respective opposed ends may comprise any suitable weather sealing means. For example the interengaging means may comprise an overlapping skirt portion on one end and an underlying skirt portion on the other end. The mating faces of the overlapping skirt portion and the underlying skirt portion may be provided with complementary surfaces features cooperating in use to form a weather impeding labyrinth. For example, there may be provided transverse ribs on one surface adapted to engage transverse grooves on the other surface. The features may be such that they are interengaged against the resilient bias of the material of construction.

In a further aspect the present invention resides in cladding apparatus for covering the junction between a roof and a fascia including:

- an elongate body member having an inner surface and an outer surface, each surface extending between opposed ends and opposed elongate side edges of the body member, a body member portion overlying said roof having a flange dependent toward said roof from, and extending along, said elongate edge, said opposed ends respectively comprising an overlapping skirt portion on one said end and an underlying skirt portion on the other said end permitting substantially weatherproof engagement between adjacent body members when laid in longitudinal sequence;
- an elongate roof batten sealingly supported on said roof, said roof batten including an upper surface against which the inner surface of said body member bears in use, one or both of said inner surface and upper surface being provided with one or more elongate grooves forming in use a moisture excluding labyrinth between said inner surface and said upper surface;
- mounting means associated with said fascia and adapted to engage at least one complementary mounting portion provided on said inner surface, said mounting portion and mounting means being substantially continuous along their respective lengths and provided with complementary profiles permitting connection therebetween by longitudinally sliding said mounting portion on said mounting means by sliding from one end of said mounting batten.

Where the adjacent cladding portions form intersecting planes, in order to provide an aesthetic appearance the body member may comprise a pair of webs each adapted to overlie a respective cladding portion in use, the webs being separated by curved portion adapted to overlie the junction.

According to a further aspect of the invention there is provided a cladding apparatus for finishing an exposed side edge of overlapping slab members adjacent a fascia panel, said cladding apparatus including:

a body portion having an inner surface and an outer surface said body portion and extending longitudinally between a leading edge and a trailing edge between opposed side edges;

said body portion having side portions extending outwardly from an arcuate central portion, wherein a first side portion may be disposed laterally of said central arcuate portion and a second side portion may depend from said arcuate portion;

the leading edge and the trailing edge provided with complementary inter-engaging formations permitting said body portion to overlap a next adjacent body portion when laid in longitudinal sequence; and at least one elongate support web provided on an inner surface of the second side portion.

Suitably said at least one elongate support web is provided with a spigot end portion.

The formation of the leading edge may be and overlapping skirt portion and the formation of the trailing edge may be underlying recess portion.

The cladding apparatus suitably includes a longitudinal guide member having a lower face having a stepped configuration arranged for fitting with said overlapping slab members, and an upper face having at least one longitudinal groove for supporting a side portion of said arcuate body.

The cladding apparatus suitably includes a longitudinal support member having an inner face for attaching to a fascia panel and an outer face having at least one recess for receiving said at least one elongate support web of a depending web portion of said arcuate body.

According to a yet further aspect of the present invention there is provided a method for finishing an exposed side edge of overlapping slab members adjacent a fascia panel the method including the steps of:

lying a longitudinal guide member having a lower face with a stepped configuration on the overlapping slab members along faces adjacent the side edge;

attaching a longitudinal support member having a recess to the fascia panel;

engaging at least one cladding body portion, having an elongate support web provided on an inner surface thereof, with said recess of the support member.

According to a yet further aspect of the present invention there is provided a cladding installation for overlapping slabs adjacent a fascia panel composed of a plurality of engaged cladding bodies and longitudinal members of the first aspect of the invention.

According to a yet further aspect of the present invention there is provided a longitudinal batten member attachable to a cladding surface said member having a recess lying in a first plane for inter-engagement with a spigot portion of a cladding member.

According to a yet further aspect of the present invention there is provided a cladding member comprising:

a substantially planar body having inner and outer faces;

a web extending outwardly from a first end of the inner face of said body;

a first projection extending from said web along said body; and a second projection extending outwardly from a second end of the inner face of said body.

Optionally the first and second projections have an enlarged portions provided thereon.

According to a yet further aspect of the present invention there is provided a cladding system for removably attaching a cladding member to a cladding surface including:

a longitudinal commencing batten member attachable to the cladding surface said member having means lying in a first plane for inter-engagement with a first portion of the cladding member; and at least one longitudinal connecting batten member attachable to a cladding surface having means lying in a second plane disposed at an angle to said first plane, for inter-engagement with a second portion of said cladding member and having means lying in a plane disposed parallel to said first plane for inter-engagement with a portion of an adjacent cladding member.

Preferably said second plane lies normally to the first plane.

Optionally the system includes a longitudinal terminating batten member having means lying in a plane disposed parallel to said first plane for inter-engagement with a portion of said adjacent cladding.

Preferably the means for inter-engagement with said first portion of the cladding member is a recess, which may be provided substantially along the length of said commencing batten member. In this embodiment said first portion of the cladding member is preferably a projection which extends from a web depending from said cladding member. The projection may have an enlarged portion which assists in inter-engagement with said commencing batten member.

The means for receiving said second portion of said cladding member is preferably a recess which may be provided substantially along the length of said connecting batten member. Additionally, the means for inter-engagement with said portion of the adjacent cladding member is a recess which may be provided substantially along the length of said connecting batten member.

BRIEF DESCRIPTION OF THE DRAWINGS

The invention will be further described with reference to preferred embodiments thereof as illustrated in the accompanying drawing and wherein.

DETAILED DESCRIPTION OF THE INVENTION

Figure 1:
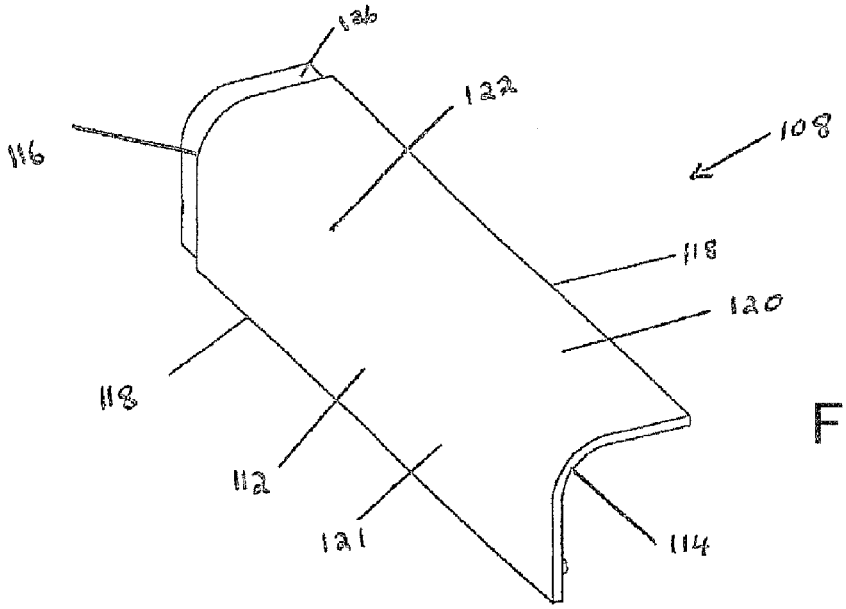
FIG. 1 is a perspective view of a body portion of a cladding apparatus in accordance with an embodiment the present invention.
Figure 2:
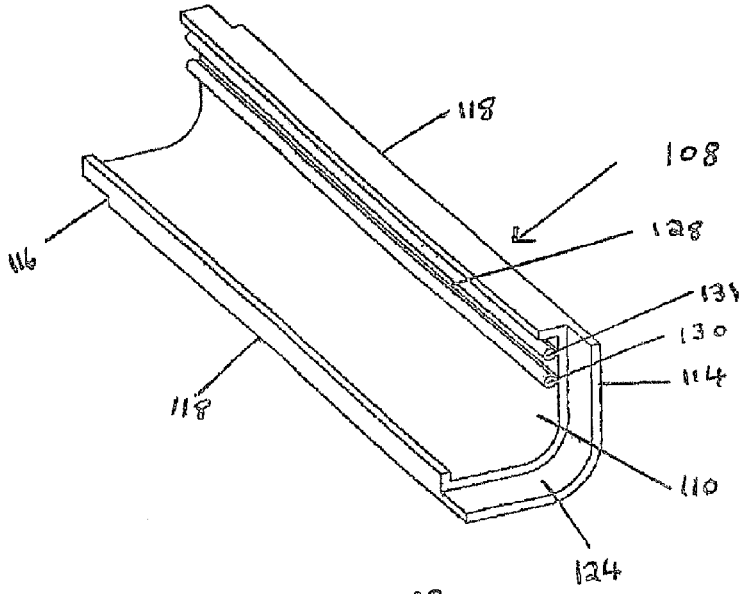
FIG. 2 is a perspective view of the body portion illustrated in FIG. 1 in the underside.

FIG. 1 illustrates a body portion 108 utilised in the cladding apparatus of the present invention. The portion 108 has an inner surface 110 (see FIG. 2) and an outer surface 112 (see FIG. 1). The inner surface 110 and the outer surface 112 extend longitudinally between a leading edge 114 and a trailing edge 116. The leading edge 114 and trailing 116 extend between opposed side edges 118.

Figure 3:
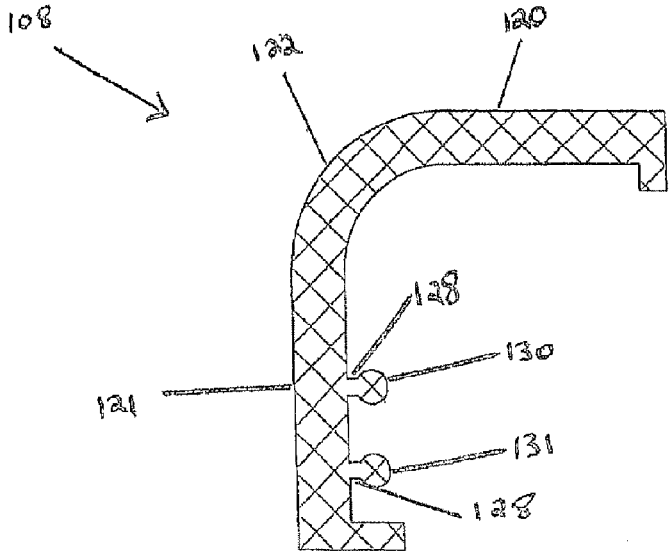
FIG. 3 is a cross-sectional view of the body portion of FIG. 2.

The body portion 108 is made has a curved shape having first 120 side portion (see FIG. 3) arranged to be disposed laterally from an arcuate central portion 122 and a second 121 side portion depending from said arcuate portion.

Figure 9:
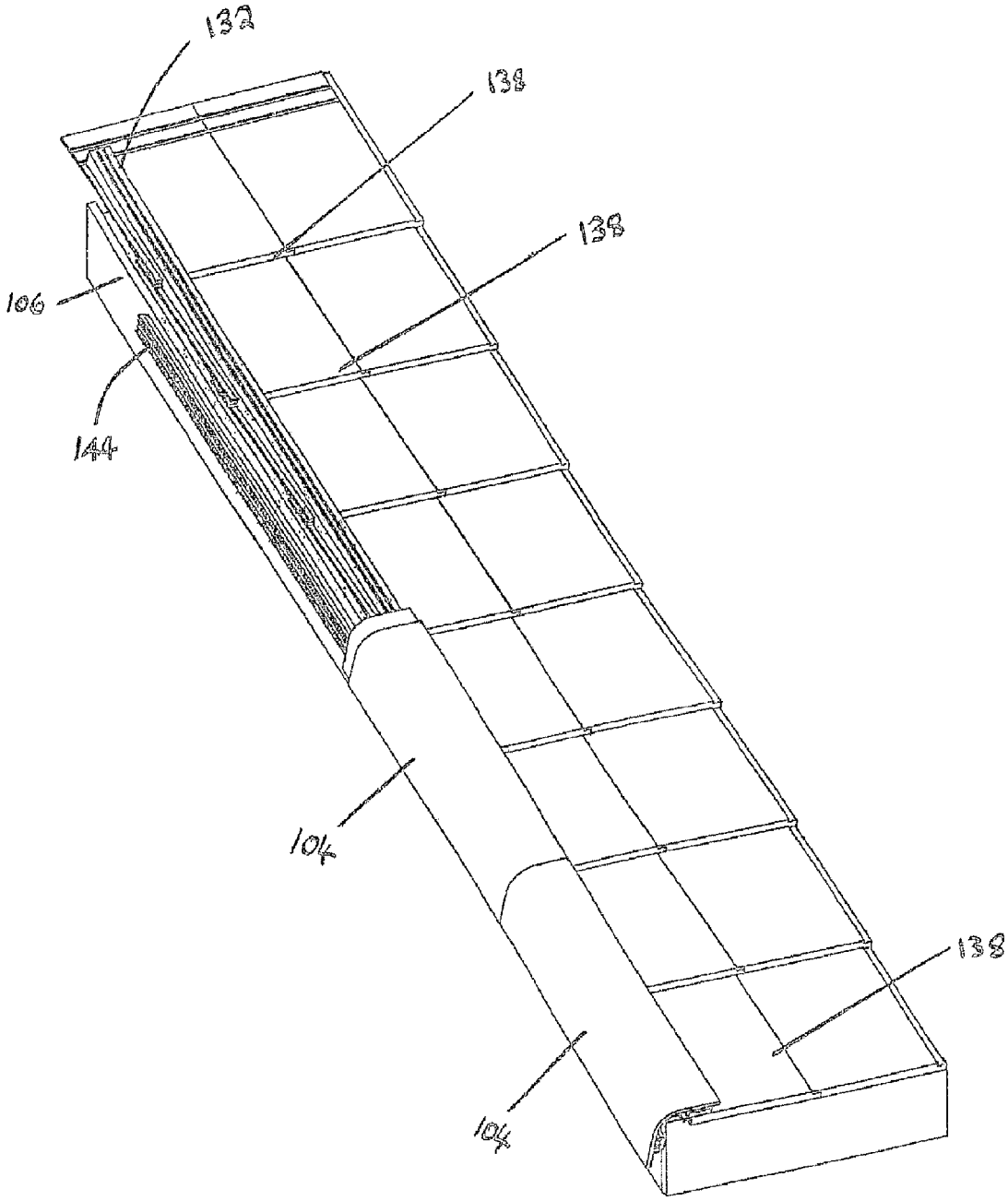
FIG. 9 is a perspective view of the completed cladding installation in accordance with an embodiment of the invention.

The leading edge 114 (see FIG. 2) is provided with a formation 124 which inter-engages with complimentary formation 126 (see FIG. 1) provided on an adjacent body portion thereby permitting the body portions to inter-engage when laid in a longitudinal sequence (see FIG. 9).

The body portion 108 is also provided with a pair of longitudinally extending elongate support webs 128 on the inner surface 110 thereof. The end portions 130 and 131 of said elongate support webs 128 are both provided with a spigot end portion.

Figure 4:
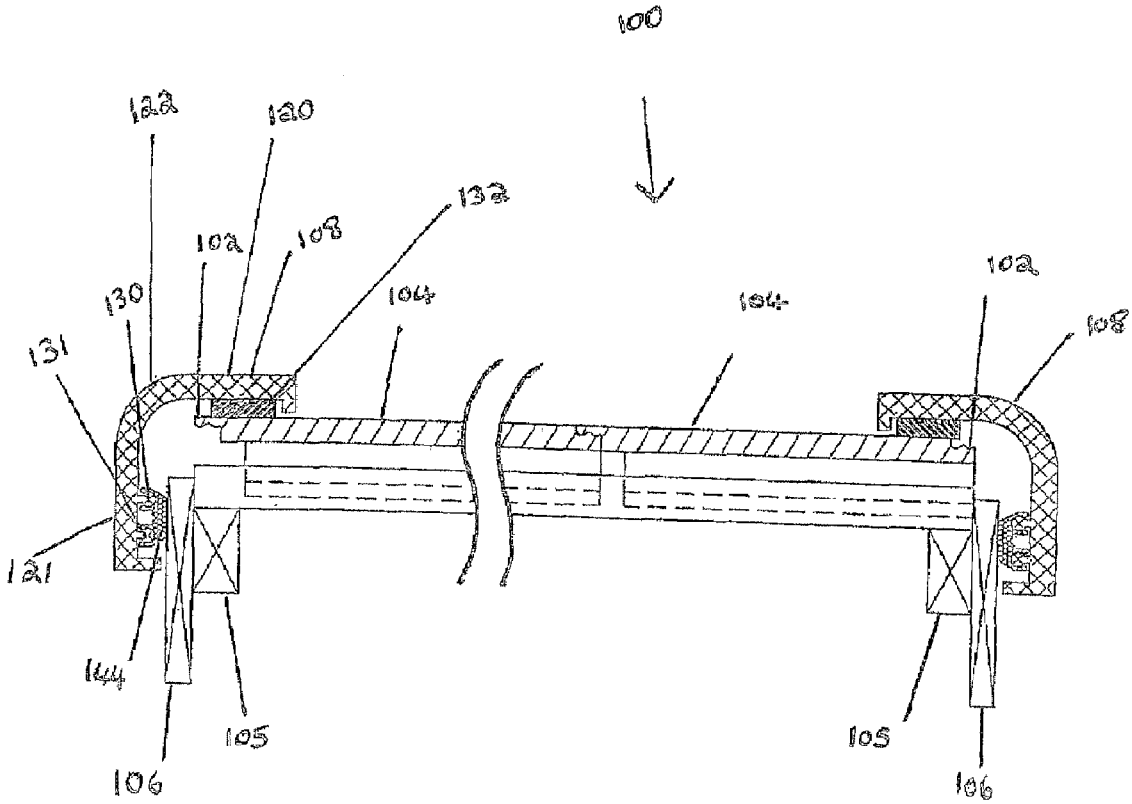
FIG. 4 is a cross-sectional view of the apparatus of FIGS. 1 to 3 finishing exposed side edge of a tiled roof structure.
Figure 5:
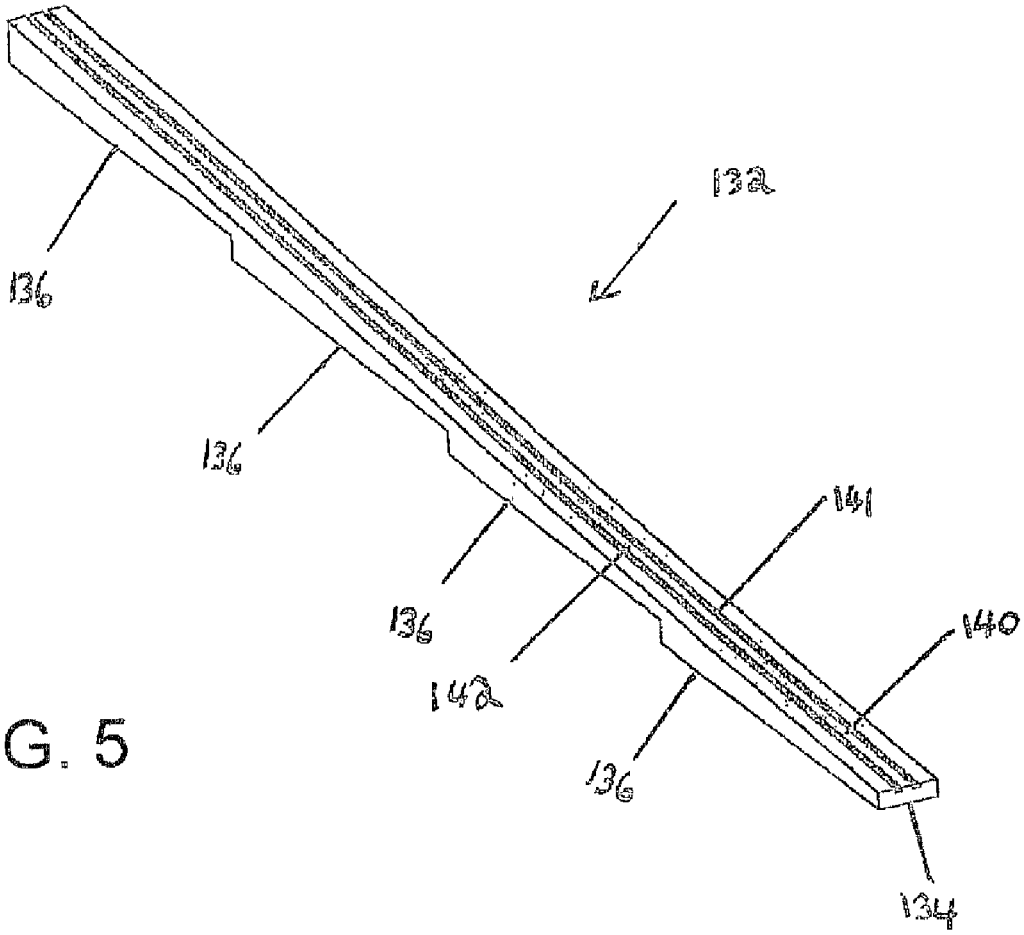
FIG. 5 is a perspective view of a guide member in accordance with an embodiment of the present invention.
Figure 6:
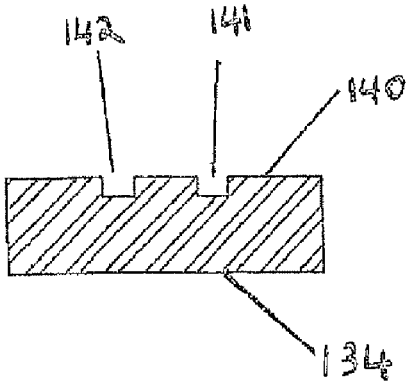
FIG. 6 is a cross-sectional view of the guide member of FIG. 5.
Figure 7:
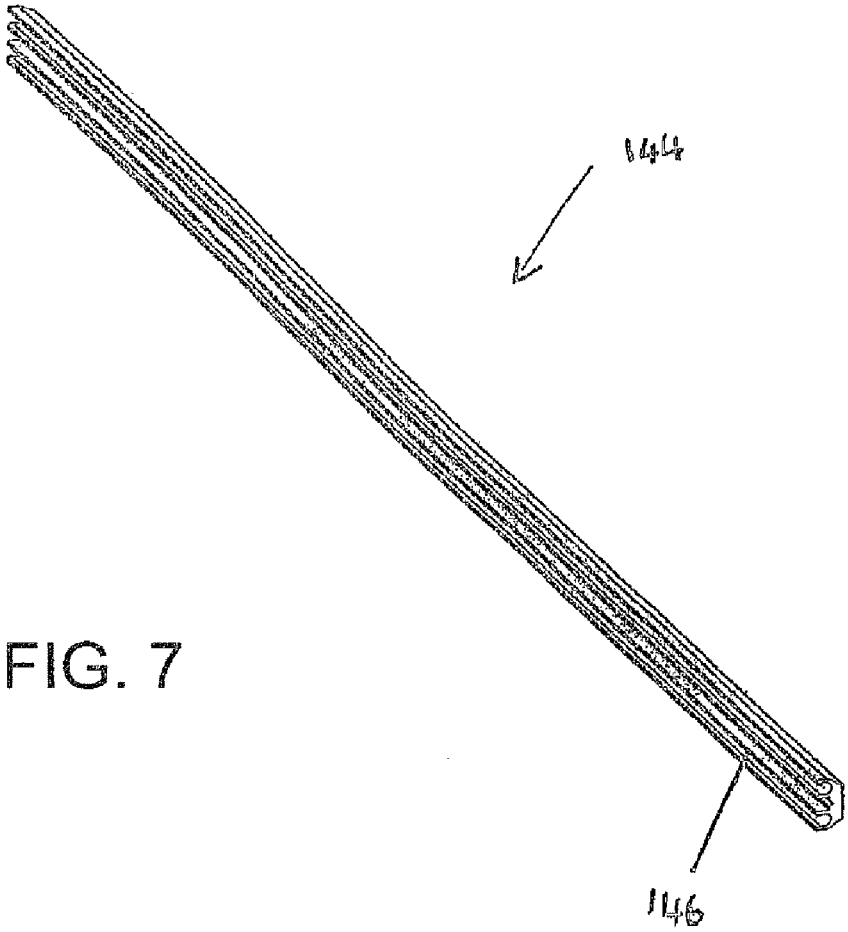
FIG. 7 is a perspective of a support member in accordance with an embodiment of the invention.
Figure 8:
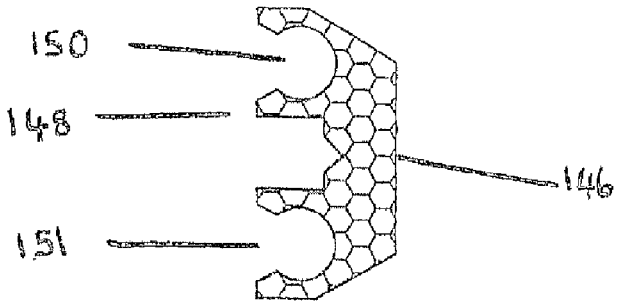
FIG. 8 is an end view of the port member of FIG. 7.

One particular use of the cladding apparatus of the present invention is to finish the side edge of slab members, such as roof tiles to resist ingress of rain water and provide a more attractive look for the roof rather than having the side edges of the tiles exposed. As illustrated in FIG. 9 the tiles 104 are laid in an overlapping pattern over preinstalled roofing battens (not shown). A guide member 132 is laid on the exposed edge of the tiles. The guide member (see FIG. 5) extends longitudinally for the required length of the tiles 104. The guide member has on its lower face 134 a plurality of steps 136 which compensate for the overlapping nature of the tiles to provide a level upper face 140 when laid on the tiles 104. A longitudinal support member 144 (see FIG. 4) is also fixably attached by its inner face 146 to the facsia panel 106 adjacent to the exposed edge of the tiles 104.

Turning to figure 9, the support member 144 is shown extending longitudinally along the length of the overlapping tiles 104. The support member may be attached to the fascia 106 by any convenient means such as gluing or nailing. The support member itself has an outer face 148 into which a pair of recesses 150 and 151 are provided.

The body portions 108 are placed adjacent to the exposed edges of the tiles 102 with the support webs 128 engaging within the recesses 150 and 151 of the support member 144. The first side portion 120 of the body portion 121 is also supported by the grooves 141 in the upper face of the guide member 132. (See FIGS. 4 and 9) The required number of body portions is placed along the exposed edge of the tiles to provide the required finish. Of course both of the opposing side edges of the tiles can be finished using the cladding apparatus of the present invention (see FIG. 4).

The required number of body portions is placed along the exposed edge of the tiles to provide the required finish. Of course both of the opposing side edges of the tiles can be finished using the cladding apparatus of the present invention (see FIG. 4).

Figure 10:
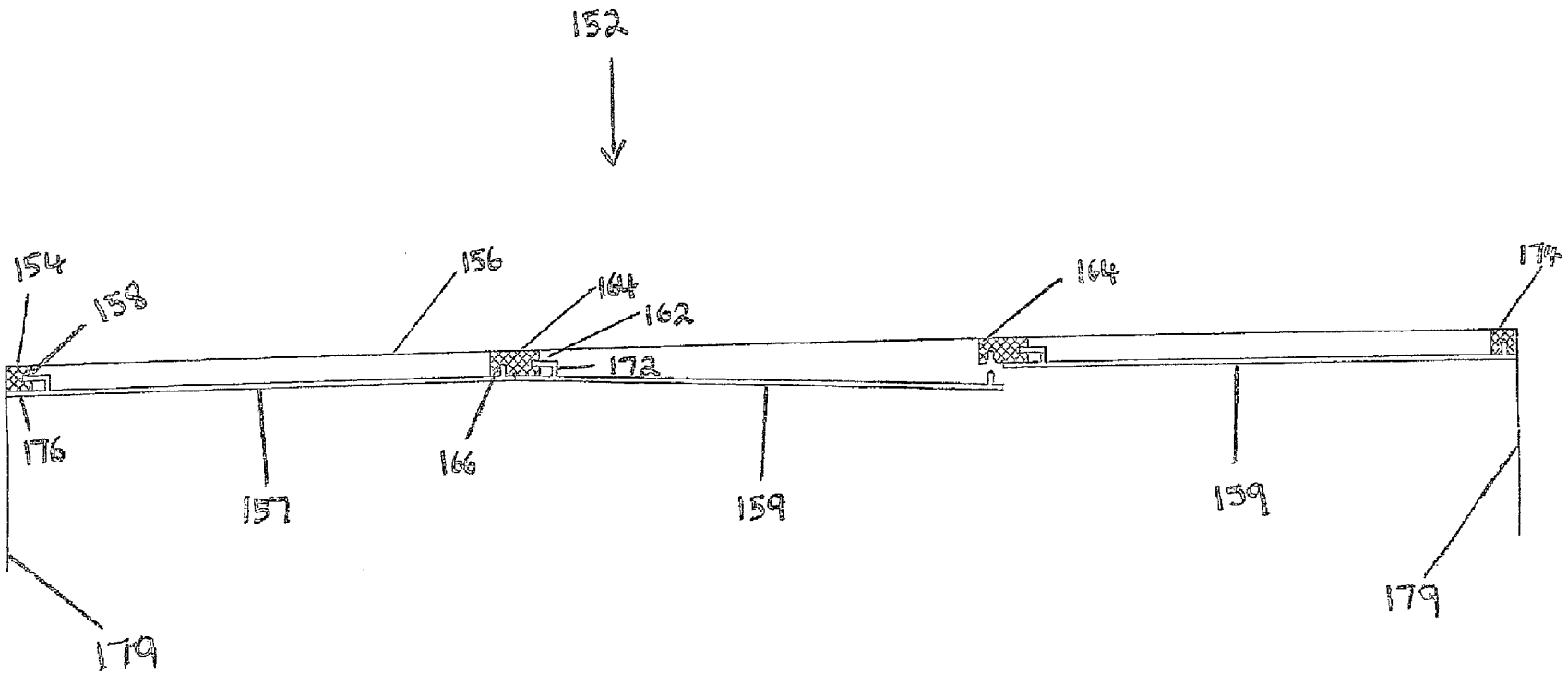
FIG. 10 is an end view of a ceiling utilising the cladding system in accordance with an embodiment of the present invention.
Figure 11:
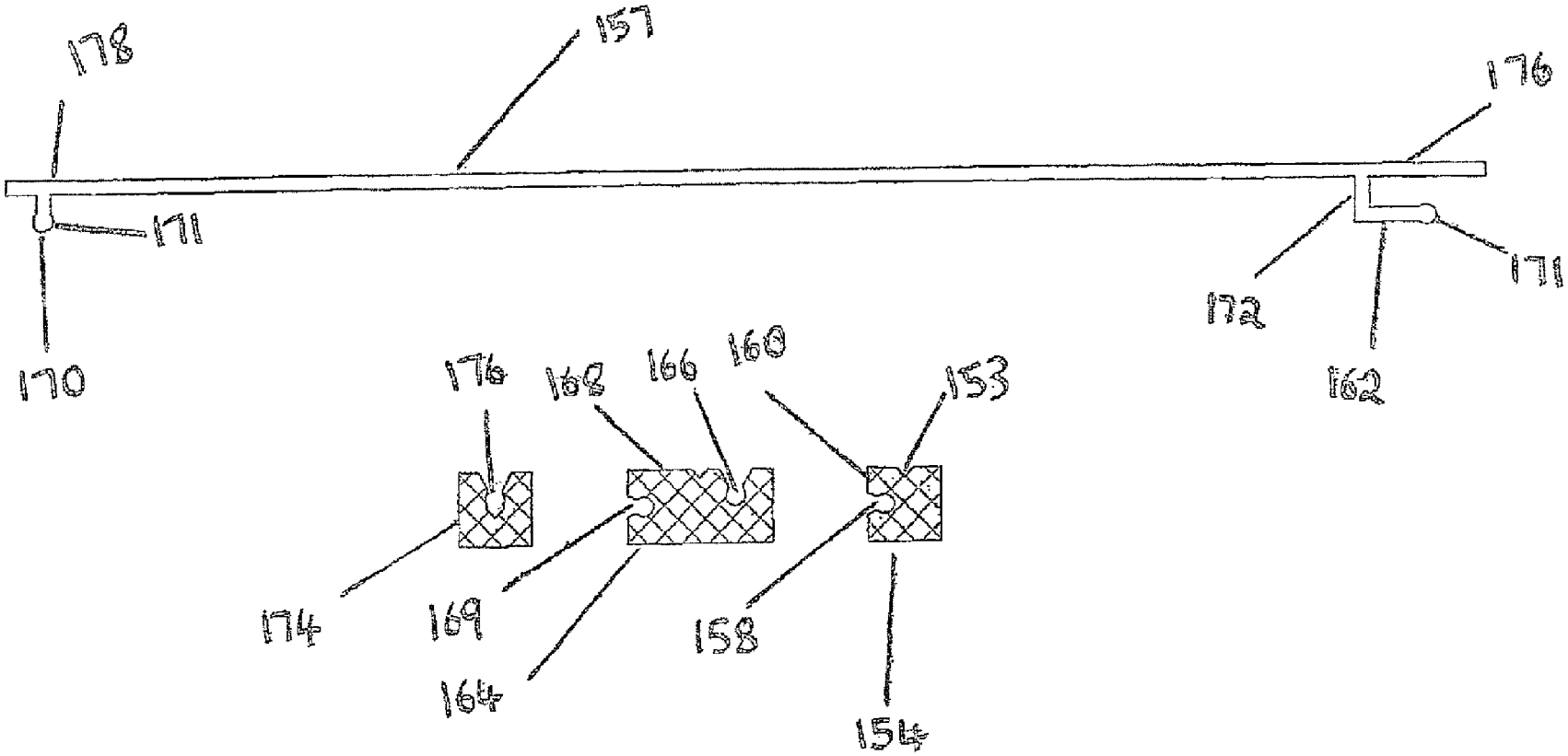
FIG. 11 is an end view of batten members and cladding members in accordance with an embodiment of the invention.

Turning to FIG. 10 the cladding system 152 of the present invention is illustrated. The cladding system may be used to clad any convenient cladding surface 156. The cladding surface 156 illustrated in FIG. 10 is a ceiling, however it will be apparent that the cladding system 152 of the present invention may be utilised on other cladding surfaces for example walls be internal or external walls or floors. The cladding apparatus illustrated in FIG. 10 shows a single row of cladding members 157, 159. In practice a plurality of rows of cladding members would be provided adjacent to each other to fully cover the cladding surface. The cladding system of the present invention includes a longitudinal commencing batten member 154 (see FIG. 11) which is attached to the cladding surface by any convenient means such as nailing or gluing. The commencing batten member 154 has a recess 158 which lies in a first plane 160 of the batten member 154. The commencing batten member 154 is also provided with a groove 153.

A plurality of continuing batten members 164 are also attached to the cladding surface 156 spaced at a distance which matches the length of the cladding member 158, 159 that are used. The connecting batten member 164 also has a recess 166 provided in a plane 168 which lies normally to the first plane 160 of the commencing batten member 154 when those members are attached to the cladding surface. The connecting member 164 also has a further recess 169 lying in a plane parallel to the first plane of the commencing batten member 154.

The cladding system might also include a terminating batten member 174 which is attached to the cladding surface at the opposite end to the commencing member 154.

A first cladding member 157 has a projection 162 extending from a web 172 which depends from the cladding member 157. The projection 162 is provided with an enlarged portion 171 at the end thereof. This 171 portion is for locating within the recess 158 of the commencing batten member. The leading section 176 of the cladding member continues along the face of the commencing batten member 154. The trailing portion 178 of the cladding member 157 also has a projection 170 with an enlarged portion 171. This enlarged portion 171 engages in the recess 166 of the connecting batten member. An adjacent cladding member 159 with a web 172 and projection 162 is then engaged within the recess 169 of the connecting batten member 164. The required of connecting batten members 164 are provided on the cladding surface with corresponding cladding members 159 and engaged therein. The cladding member 159 that is adjacent to the terminating batten member 174 is then engaged within the recess 176 of that batten member, therein completing the column. It will be appreciated from FIG. 10 that the cladding members are, when installed, in an abutting relationship within a single row, as illustrated. Also, the side edges of adjoining rows will, when installed be in an abutting relationship.

It will be realised by those skilled in the art that the present invention provides a cladding apparatus that is quick easy to install when compared with current apparatus in use. In particular, the ability to install the cladding by a simple sliding action rather than through the use of specialist tools represents an improvement upon current cladding apparatus and systems.

It will of course be realised that while the above has been given by way of illustrative example of this invention or such another modifications and variations thereto as would be apparent to persons skilled in the art deemed to fall within the broad scope and ambit of this invention as defined in the claims appended hereto.

The invention claimed is:

1. A cladding apparatus covering a junction between a roof and a fascia of a building, wherein said apparatus comprises:

an elongated body member having an inner surface and an outer surface, each surface extending between opposed ends and opposed elongate side edges of the body member;

a mounting batten secured to said fascia and adapted to engage at least one complementary mounting portion provided on said inner surface; wherein said mounting portion and mounting batten are provided with complementary profiles permitting snap-in connection therebetween;

complementary inter-engaging means provided on respective said opposed ends and permitting substantially weatherproof engagement between adjacent body members when laid in longitudinal sequence.

2. The cladding apparatus according to claim 1, wherein the body member portion overlying said roof is adapted to impede ingress of weather under said body member in use.

3. The cladding apparatus according to claim 2, wherein said body member portion overlying said roof impedes ingress of weather under said body member by means of a flange dependent toward said roof from, and extending along, said elongate edge.

4. The cladding apparatus according to claim 3, wherein said flange in use has its lower edge clear of said roof, so as not to interfere with intimate contact of said upper and inner surfaces.

5. The cladding apparatus according to claim 3, wherein said roof is provided with an elongate roof batten sealingly supported on said roof, said roof batten including an upper surface against which the inner surface of said body member bears in use.

6. The cladding apparatus according to claim 5, wherein said roof comprises a shingle laid roof, said roof batten having a profile selected to conform to said shingle laid roof.

7. The cladding apparatus according to claim 5, wherein one or both of said inner surface and upper surface are provided with one or more elongate grooves forming, in use, a moisture-excluding labyrinth between said inner surface and said upper surface.

8. The cladding apparatus according to claim 1, wherein said complementary inter-engaging means provided on respective said opposed ends comprise a formation of an overlapping skirt portion on one said end and a formation of an underlying skirt portion on the other said end.

9. The cladding apparatus according to claim 8, wherein mating faces of said overlapping skirt portion and said underlying skirt portion are provided with complementary surfaces features cooperating in use to form a weather impeding labyrinth.

10. The cladding member according to claim 1, wherein adjacent cladding portions of said roof and said fascia form intersecting planes and wherein the body member comprises a pair of webs each adapted to overlie a respective said cladding portion in use, said webs being separated by a curved portion adapted to overlie said junction.

11. A cladding apparatus covering a junction between a roof and a fascia, wherein said apparatus comprises:

an elongated body member having an inner surface and an outer surface, each surface extending between opposed ends and opposed elongate side edges of the body member, a body member portion overlying said roof having a flange dependent toward said roof from, and extending along, said elongate edge, said opposed ends respectively comprising a formation of an overlapping skirt portion on one said end and a formation of an underlying skirt portion on the other said end permitting substantially weatherproof engagement between adjacent body members when laid in longitudinal sequence;

an elongate roof batten sealingly supported on said roof, said roof batten including an upper surface against which the inner surface of said body member bears in use, one or both of said inner surface and upper surface being provided with one or more elongate grooves forming, in use, a moisture-excluding labyrinth between said inner surface and said upper surface;

a mounting batten secured to said fascia and adapted to engage at least one complementary mounting portion provided on said inner surface, said mounting portion and mounting batten being substantially continuous along their respective lengths and provided with complementary profiles permitting connection therebetween by longitudinally sliding said mounting portion on said mounting batten by sliding from one end of said mounting batten.

12. The cladding member according to claim 11, wherein adjacent cladding portions of said roof and said fascia lie in respective intersecting planes and wherein the body member comprises a pair of webs each adapted to overlie a respective said cladding portion in use, said webs being joined by a curved portion adapted to overlie the junction of said intersecting planes.

* * * * *